US010858166B2

(12) United States Patent
Fresnel

(10) Patent No.: US 10,858,166 B2
(45) Date of Patent: Dec. 8, 2020

(54) METHOD FOR PROTECTING A CONTAINER, AND CONTAINER PROTECTED IN THIS WAY

(71) Applicant: SLEEVER INTERNATIONAL COMPANY, Morangis (FR)

(72) Inventor: Eric Fresnel, Paris (FR)

(73) Assignee: SLEEVER INTERNATIONAL COMPANY, Morangis (FR)

( * ) Notice: Subject to any disclaimer, the term of this patent is extended or adjusted under 35 U.S.C. 154(b) by 31 days.

(21) Appl. No.: 14/763,359

(22) PCT Filed: Feb. 19, 2014

(86) PCT No.: PCT/EP2014/053260

§ 371 (c)(1),
(2) Date: Jul. 24, 2015

(87) PCT Pub. No.: WO2014/128179

PCT Pub. Date: Aug. 28, 2014

(65) Prior Publication Data

US 2015/0360841 A1 Dec. 17, 2015

(30) Foreign Application Priority Data

Feb. 22, 2013 (FR) ..... 13 51600

(51) Int. Cl.
*B65D 81/02* (2006.01)
*B65D 23/08* (2006.01)
(Continued)

(52) U.S. Cl.
CPC ..... *B65D 81/02* (2013.01); *B65B 53/02* (2013.01); *B65D 1/023* (2013.01); *B65D 23/001* (2013.01); *B65D 23/003* (2013.01); *B65D 23/0878* (2013.01); *B65D 85/307* (2013.01)

(58) Field of Classification Search
CPC ..... B65D 23/0878; B65D 23/0857; B65D 23/085; B65D 23/0842; B65D 23/0871;
(Continued)

(56) References Cited

U.S. PATENT DOCUMENTS 1,890,323 A * 12/1932 Glaeser ..... B65D 23/0885 215/12.1
3,698,586 A 10/1972 Terner
(Continued)

FOREIGN PATENT DOCUMENTS

DE 29915618 U1 * 1/2000 ..... B65D 23/0885
GB 191404689 A * 4/1914 ..... B65D 49/10
(Continued)

*Primary Examiner* — Allan D Stevens
(74) *Attorney, Agent, or Firm* — Muncy, Geissler, Olds & Lowe, P.C.

(57) ABSTRACT

The invention relates to a method of protecting a container (1) against impacts, the container presenting a body (2) that is terminated at one end by a bottom and at the other end by a transition portion (4) leading to a neck (3), the method comprising the steps of:

putting a bottom cup (5) into place on the container to cover the bottom of the container and project laterally from the body of the container;

putting a top cup (6; 60) into place on the container pressing against the transition portion of the container in order to project laterally from the body of the container;

covering the assembly with the help of a sleeve (20) of heat-shrink material; and heat-shrinking the sleeve.

15 Claims, 3 Drawing Sheets

(51) Int. Cl.

| | |
|---|---|
| ***B65D 23/00*** | (2006.01) |
| ***B65D 85/30*** | (2006.01) |
| ***B65B 53/02*** | (2006.01) |
| ***B65D 1/02*** | (2006.01) |

(58) Field of Classification Search

CPC ..... B65D 23/0885; B65D 23/08; B65D 85/30778; B65D 81/02; B65D 81/03; B65D 81/05; B65D 81/022; B65D 85/307; A61J 9/08

USPC ..... 215/12.2, 12.1, 386; 206/521, 591, 592, 206/594, 523, 583, 588, 593

See application file for complete search history.

(56) References Cited

U.S. PATENT DOCUMENTS 3,744,658 A * 7/1973 Fujio ..... A61M 5/1417 215/12.1
3,972,435 A 8/1976 Sasaki et al.
4,219,124 A * 8/1980 Amberg ..... B65D 23/0878 215/12.2
4,241,839 A * 12/1980 Alberghini ..... B65D 23/001 215/12.1
4,482,067 A * 11/1984 Saito ..... B65D 23/001 206/509
4,609,418 A * 9/1986 Yoshino ..... B29C 65/7858 156/294
4,880,126 A * 11/1989 Anderson ..... B65D 23/001 215/386
8,763,825 B2 * 7/2014 Wauters ..... B65D 1/16 206/503
2001/0038014 A1 * 11/2001 Donelson ..... B65D 23/001 220/592.21
2009/0184116 A1 * 7/2009 Laske ..... A01K 5/0114 220/4.28

FOREIGN PATENT DOCUMENTS

GB 357678 A * 10/1931 ..... B65D 23/0885
WO WO 2012168269 A1 * 12/2012 ..... B65D 23/0885

* cited by examiner

METHOD FOR PROTECTING A CONTAINER, AND CONTAINER PROTECTED IN THIS WAY

The invention relates to a method of protecting a container against impacts, and to a container protected in this way.

BACKGROUND OF THE INVENTION

In certain fields, in particular in pharmacy, use is made of liquid-containing glass bottles.

Dropping such a bottle or allowing it to strike an obstacle often ends in the bottle breaking. Furthermore, transporting such bottles requires certain precautions to be taken and often imposes the use of individual packages.

Various solutions have been proposed for protecting such a bottle from risks associated with impacts or being dropped. For example, document WO 2011/006089 describes a bottle that is completely covered in a sleeve of elastomer material. Document US 2010/0072162 shows a glass bottle covered in protection comprising two half-shells fitted around the bottle. Document CN 201912469 shows a baby's bottle fitted with a bottom cup engaged on the bottom of the bottle and with a ring that is positioned on the screw thread that receives the bushing carrying the teat.

OBJECT OF THE INVENTION

The invention seeks to provide an alternative to known methods of protecting containers.

SUMMARY OF THE INVENTION

In order to achieve this object, the invention provides a method of protecting a container against impacts, the container presenting a body that is terminated at one end by a bottom and at the other end by a transition portion leading to a neck, the method comprising the steps of:

- putting a bottom cup into place on the container to cover the bottom of the container and to project laterally from the body of the container;
- putting a top cup into place on the container pressing against the transition portion of the container in order to project laterally from the body of the container;
- covering the assembly with the help of a sleeve of heat-shrink material; and
- heat-shrinking the sleeve.

Thus, the cups are secured to the bottle by a sleeve that has been subjected to heat-shrinking, and they constitute bumpers that contribute to protecting the bottle and that limit the risk of the bottle breaking. The cups are held firmly on the bottle by the sleeve, which may also contribute to damping impacts, where appropriate. Furthermore, in the event of the bottle breaking, the sleeve serves to prevent pieces of glass from being dispersed.

Furthermore, the cups are held securely and cannot escape from the container.

In addition, the cups change the shape of the container, making it easier to hold in the hand. A user can thus manipulate the container more easily, thereby implicitly reducing any risk of said container being dropped. This is particularly true when the body of the container is in the form of a circular cylinder, where the cups "break" the line of said body.

The cups are preferably made of deformable material that is suitable for providing effective protection. Also preferably, the cups co-operate with the container to define respective annular volumes full of air.

In a particular embodiment, the body of the container is in the shape of a circular cylinder.

As a result, the body of the container is simple in shape, thereby making it easier to clean.

BRIEF DESCRIPTION OF THE DRAWINGS

The invention can be better understood in the light of the following description of particular implementations of the invention given with reference to the figures of the accompanying drawings, in which.

DETAILED DESCRIPTION OF IMPLEMENTATIONS OF THE INVENTION

Figure 1:
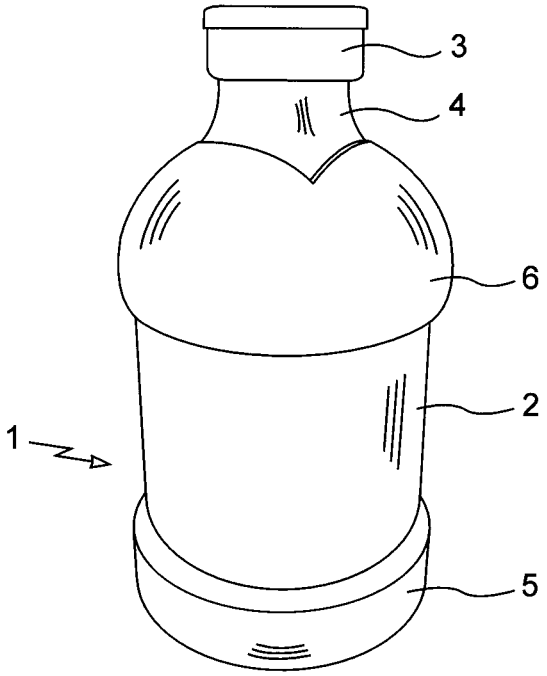
FIG. 1 is a perspective view of a container fitted with cups of the invention.

With reference to FIG. 1, the method of the invention consists in preparing a container, in this example a glass bottle 1 comprising a body 2 that is substantially circularly cylindrical and terminated at its bottom end by a bottom, together with a neck 3 connected to the body 1 by a transition portion 4.

The bottle 1 is thus provided with a bottom cup 5 that is engaged on the bottom end of the bottle in order to cover its bottom, and a top cup 6 that is engaged on the bottle so as to bear against the transition zone of the bottle. It can be seen that the cups project from the side wall of the body 2 so as to form dampers for protecting the bottle 1 in the event of impacts thereagainst.

Figure 2A:
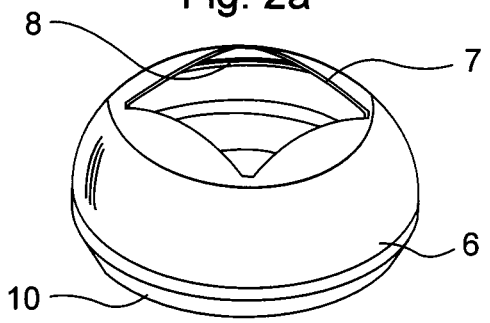
FIGS. 2*a* and 2*b* are perspective views of a top cup used on the FIG. 1 container.
Figure 2B:
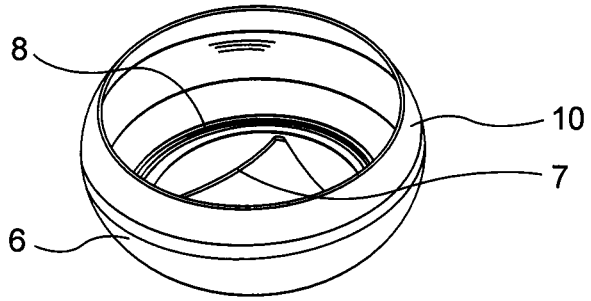

With reference to FIGS. 2*a* and 2*b*, the top cup 6 is generally rounded in shape and presents a top opening (of square shape in this example) for passing the neck 3 of the bottle 1. The top cup 6 has a first peripheral stiffener 8 in the form of a circular bead that projects from the inside face of the top cup 6 so as to bear against the wall of the bottle 1, and a second peripheral stiffener in the form of a skirt 10 that terminates the top cup 6 and that defines a terminal lip that comes into contact with the wall of the bottle 1. The top cup 6 is generally rounded in shape, projecting considerably from the side wall of the body of the container and presenting an outwardly convex surface to the outside that is suitable for coming into contact with any obstacle that the bottle might strike.

Figure 3B:
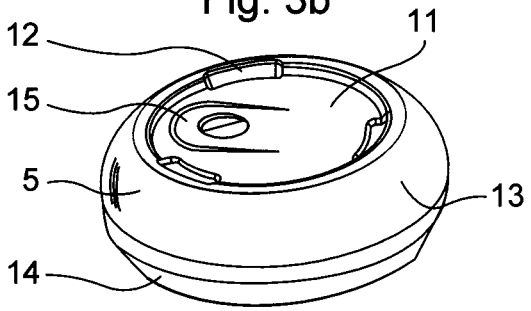
FIGS. 3*a* to 3*c* are perspective views of a bottom cup used on the FIG. 1 container.
Figure 3C:
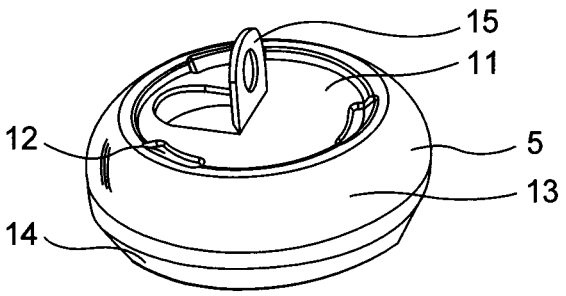
Figure 3A:
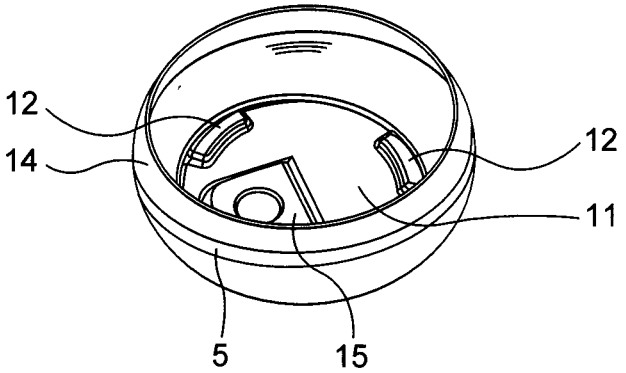

With reference to FIGS. 3*a* to 3*c*, the bottom cup 5 has a bottom 11 with three bosses 12 to enable the bottom 11 of the bottom cup to come into abutment against the bottom of the bottle 1. The bottom 11 is associated with a collar 13 terminated by a skirt 14 that defines a terminal lip coming into contact with the wall of the bottle 1. In this example, the bottom 11 is precut to allow a tab 15 to be released and folded, which tab may be used for example for hanging up the bottle 1. The bottom cup 5 is generally rounded in shape, projecting considerably from the side wall of the body of the container and presenting an outwardly convex surface to the outside that is suitable for coming into contact with any obstacle that the bottle might strike.

Figure 4:
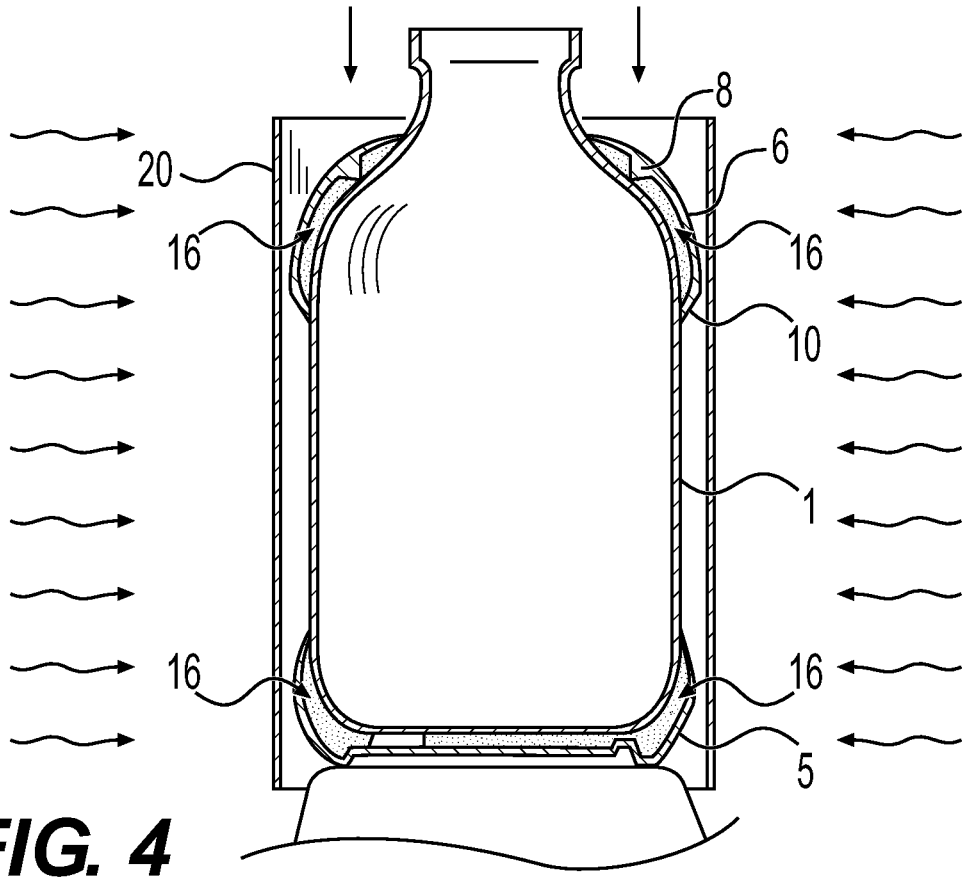
FIG. 4 is a section view of the container with the cup already in position, while the container is being prepared by being covered by a heat-shrink sleeve.

As can be seen in FIG. 4, the cups 5 and 6 are of shapes that co-operate with the wall of the bottle 1 to define annular volumes 16 that are full of air and that participate in absorbing impacts.

After the cups have been fitted on the container, the assembly is covered in a sleeve 20 of thermoformable material by engaging the sleeve 20 over the assembly (vertical arrows). In this respect, it should be observed that the outside shapes of the cups facilitate passing and guiding the sleeve 20 around the bottle. The thickness of the sleeve 20 is exaggerated in the figures, and in reality it is no more than a few micrometers.

Figure 5:
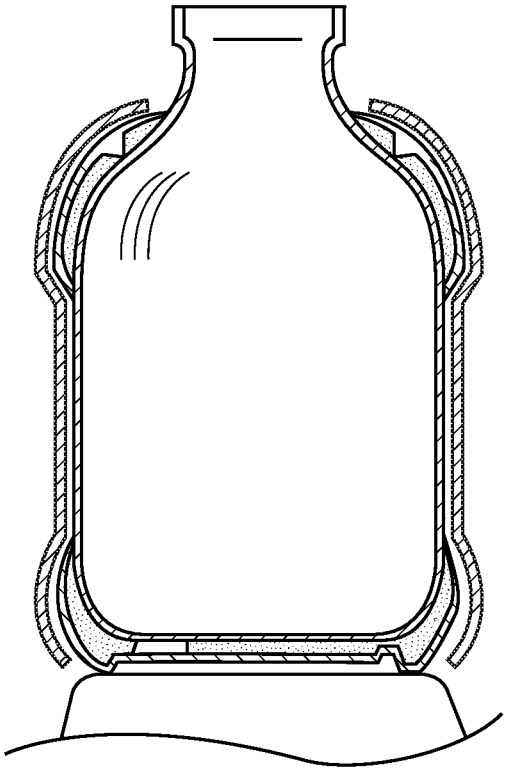
FIG. 5 is a section view of the finished container with the sleeve after heat-shrinking.

Thereafter the sleeve is heated so as to cause it to shrink. As shown in FIG. 5, the sleeve 20 then fits closely around the outside shape of the assembly and holds the cups firmly against the bottle. It is ensured that the sleeve covers the flanks of the cups 5 and 6 to a substantial extent. Optionally, the sleeve may also cover the neck fitted with its stopper, in order to provide protection against opening. The sleeve should then preferably be provided with circumferential precutting substantially at the base of the neck so as to allow the stopper to be released, while retaining the remainder of the sleeve around the assembly.

The sleeve then performs several roles. In addition to its role of providing cohesion for the assembly constituted by the bottle and the cups, the sleeve also serves, in the event of the bottle breaking, to prevent the pieces of glass from dispersing. In addition, the sleeve is pressed tightly against the cups, thereby ensuring that the assembly is leaktight, even if the bottle leaks. Finally, the sleeve may itself be made of a material that is flexible so as to participate in absorbing impacts.

A bottle that has been prepared in this way can be stored with other bottles in a common package, it being possible for the cups of the bottles to touch one another and strike against one another without risk.

By way of example, the sleeve may be made using an oriented film based on styrene, e.g. the film referenced OPS TF/095 XB from the supplier Sleever International. This film is highly transparent (which makes it possible to monitor the level of liquid in the bottle, providing the bottle is itself transparent), and it is also a good medium for printing. Its maximum shrinkage ratio exceeds 75%.

Also by way of example, the cups are made by injection-molding a resin, e.g. a low density polyethylene resin. The cups are preferably made of deformable material.

Figure 6:
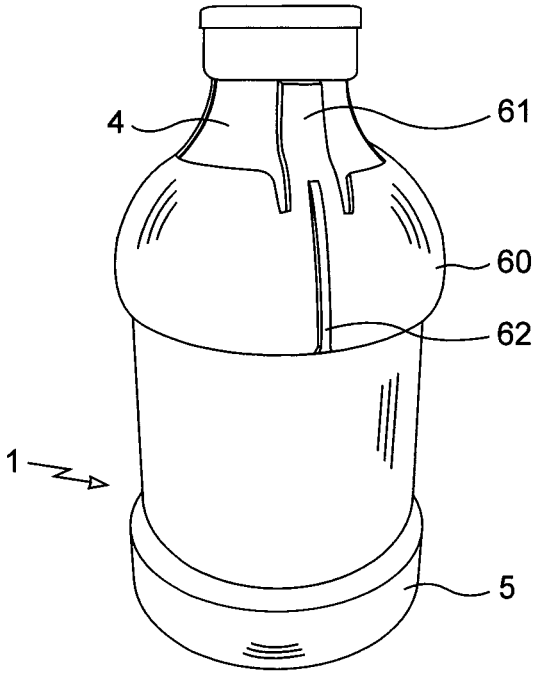
FIG. 6 is a perspective view of a container provided with a different top cup.

Naturally, the invention may be subjected to numerous variants. In particular, FIG. 6 shows a bottle fitted with a top cup 60 presenting tongues 61 that extend towards the neck and enable the cup to be clipped under the rim of the neck of the bottle, such that the top cup is held prisoner on the bottle, even before the bottle is covered by the thermoformable sleeve. In this example, the top cup presents longitudinal stiffeners 62 (one of them being visible in this figure by transparency) that bear against the wall of the bottle in order to ensure that there is a volume of air between the cup and the bottle.

The invention is not limited to the above description, but on the contrary covers any variant coming within the ambit defined by the claims.

In addition, although the cups are circular in outline, it is possible for at least one of the cups to be given an outline that is polygonal in order to make it easier to wedge containers that have been prepared in this way when they are in a common package, or in order to prevent any turning of the container.

Although the invention is particularly intended for protecting containers made of glass, the method of the invention could naturally be applied to other containers, whenever it is important to give them increased ability to withstand impacts.

The invention claimed is:

1. A method of protecting a container against impacts, the container presenting a body that is terminated at one end by a bottom and at another end by a transition portion leading to a neck, the method comprising the steps of:

putting a bottom cup into place on the container to cover the bottom of the container and project laterally from the body of the container;

putting a top cup into place on the container pressing against the transition portion of the container in order to project laterally from the body of the container;

covering an assembly of at least the container, the bottom cup and the top cup with the help of a sleeve of heat-shrink material; and heat-shrinking the sleeve, wherein the cups change the shape of the container and project from a sidewall of the body of the container, the cups having an outwardly convex surface to an outside that is suitable for coming into contact with any obstacle that the container might strike, the outwardly convex surface of the top cup extending in a longitudinal direction between a top engagement with the container and a bottom engagement with the container and the outwardly convex surface of the top cup contacts the container at the top engagement.

2. The method according to claim 1, wherein the cups have inside shapes suitable for co-operating with the container to define respective volumes of air.

3. The method according to claim 1, wherein the cups include respective peripheral stiffeners forming lips that bear against the container.

4. The method according to claim 1, wherein the top cup possesses a peripheral stiffener in the form of a bead that projects from an inside face of the top cup in order to press against the container.

5. The method according to claim 1, wherein the top cup includes a top opening that is square in shape.

6. The method according to claim 1, wherein the top cup has tongues that extend towards the neck.

7. The method according to claim 1, wherein the bottom cup has a bottom that includes a precut tab in said bottom of the bottom cup.

8. The method according to claim 7, wherein the tab is shaped to be capable of being released and folded out relative to the bottom of the bottom cup.

9. The method according to claim 1, wherein the cups are made of low density polyethylene resin.

10. The method according to claim 1, wherein the sleeve is made from a heat-shrink oriented film based on styrene.

11. A container provided with a bottom cup fitted on the container to cover a bottom of the container and to project laterally from a body of the container, and with a top cup bearing on a transition portion of the container between the body and a neck of the container in order to project laterally from the body of the container, an assembly of at least the container, the bottom cup and the top cup as a whole being covered by a sleeve that has been subjected to heat-shrinking, wherein the cups change the shape of the container and project from a sidewall of the body of the container, the cups having an outwardly convex surface to an outside that is suitable for coming into contact with any obstacle that the container might strike, the outwardly convex surface of the top cup extending in a longitudinal direction between a top engagement with the container and a bottom engagement with the container and the outwardly convex surface of the top cup contacts the container at the top engagement.

12. A method of protecting a container against impacts, the container presenting a body that is terminated at one end by a bottom and at another end by a transition portion leading to a neck, the method comprising the steps of:

putting a bottom cup into place on the container to cover the bottom of the container and project laterally from the body of the container;

putting a top cup into place on the container pressing against the transition portion of the container in order to project laterally from the body of the container;

covering an assembly of at least the container, the bottom cup and the top cup with the help of a sleeve of heat-shrink material; and heat-shrinking the sleeve, wherein the top cup has a first peripheral stiffener in the form of a circular bead that projects from an inside face of the top cup so as to bear against a wall of the container and a second peripheral stiffener in the form of a skirt that terminates the top cup and that comes into contact with said wall of the container, so that top cup is of shape that co-operate with the wall of the container to define at least one annular volume between the two stiffeners that is full of air and that participates in absorbing impacts, the cups having an outwardly convex surface to an outside that is suitable for coming into contact with any obstacle that the container might strike, the outwardly convex surface of the top cup extending in a longitudinal direction between a top engagement with the container and a bottom engagement with the container and the outwardly convex surface of the top cup contacts the container at the top engagement.

13. A method of protecting a container against impacts, the container presenting a body that is terminated at one end by a bottom and at another end by a transition portion leading to a neck, the method comprising the steps of:

putting a bottom cup into place on the container to cover the bottom of the container and project laterally from the body of the container;

putting a top cup into place on the container pressing against the transition portion of the container in order to project laterally from the body of the container;

covering an assembly of at least the container, the bottom cup and the top cup with the help of a sleeve of heat-shrink material; and heat-shrinking the sleeve, wherein the bottom cup has a bottom associated with a collar terminated by a skirt that comes into contact with a wall of the container, so that bottom cup is of shape that co-operate with said wall of the container to define at least one annular volume between the collar and the bottom of the container that is full of air and that participates in absorbing impacts, the cups having an outwardly convex surface to an outside that is suitable for coming into contact with any obstacle that the container might strike, the outwardly convex surface of the top cup extending in a longitudinal direction between a top engagement with the container and a bottom engagement with the container and the outwardly convex surface of the top cup contacts the container at the top engagement.

14. A method of protecting a container against impacts, the container presenting a body that is terminated at one end by a bottom and at another end by a transition portion leading to a neck, the method comprising the steps of:

putting a bottom cup into place on the container to cover the bottom of the container and project laterally from the body of the container;

putting a top cup into place on the container pressing against the transition portion of the container in order to project laterally from the body of the container;

covering an assembly of at least the container, the bottom cup and the top cup with the help of a sleeve of heat-shrink material; and heat-shrinking the sleeve, wherein the cups have inside shapes suitable for co-operating with the container to define respective volumes of air and the cups include respective skirts that come into contact with a sidewall of the body of the container, the cups having an outwardly convex surface to an outside that is suitable for coming into contact with any obstacle that the container might strike, the outwardly convex surface of the top cup extending in a longitudinal direction between a top engagement with the container and a bottom engagement with the container and the outwardly convex surface of the top cup contacts the container at the top engagement.

15. A method of protecting a container against impacts, the container presenting a body that is terminated at one end by a bottom and at another end by a transition portion leading to a neck, the method comprising the steps of:

putting a bottom cup into place on the container to cover the bottom of the container and project laterally from the body of the container;

putting a top cup into place on the container pressing against the transition portion of the container in order to project laterally from the body of the container;

covering an assembly of at least the container, the bottom cup and the top cup with the help of a sleeve of heat-shrink material; and heat-shrinking the sleeve, wherein the bottom cup has a bottom with bosses to enable the bosses to come into abutment against the bottom of the container, wherein the container rests on the bosses, wherein the bottom cup is of shape that co-operate with a wall of the container to define at least one annular volume between the bottom of the container and the bottom of the bottom cup that is full of air and that participates in absorbing impacts, the cups having an outwardly convex surface to an outside that is suitable for coming into contact with any obstacle that the container might strike, the outwardly convex surface of the top cup extending in a longitudinal direction between a top engagement with the container and a bottom engagement with the container and the outwardly convex surface of the top cup contacts the container at the top engagement.

* * * * *